US005820427A

United States Patent [19]

Valdes

[11] Patent Number: 5,820,427

[45] Date of Patent: Oct. 13, 1998

[54] OUTBOARD FLUSHING ADAPTOR

[76] Inventor: Oscar Valdes, 2501 SW. 21st Ter., Miami, Fla. 33145

[21] Appl. No.: 958,233

[22] Filed: Oct. 27, 1997

[51] Int. Cl.[6] ..... B63H 20/30

[52] U.S. Cl. ..... 440/88; 134/167 R

[58] Field of Search ..... 440/88, 89, 900; 134/167 R

[56] References Cited

U.S. PATENT DOCUMENTS

| | | | |
|---|---|---|---|
| 4,729,393 | 3/1988 | Ferguson | 440/88 |
| 4,842,002 | 6/1989 | Ferguson | 440/88 |
| 5,423,703 | 6/1995 | Lorenzen | 440/88 |

*Primary Examiner*—Jesus D. Sotelo
*Attorney, Agent, or Firm*—Malloy & Malloy, P.A.

[57] ABSTRACT

An adaptor assembly designed to effectively flush outboard motors by directing the flushing water directly into plurality of water inlets normally formed in the lower gear case housing portion of the outboard motor. The adaptor assembly includes a base removably attached at an inlet end thereof to a source of water such as a water hose and including an outlet end having a conduit assembly connected in water receiving relation thereto and extending outwardly therefrom. A distal end of the conduit assembly is specifically dimensioned and configured to be inserted within one or more of the water inlets formed in the outboard motor housing and form a define a focused, concentrated and generally water tight seal with the water inlets so that water may be delivered directly thereto under pressure to ensure adequate distribution throughout the entire cooling system of the outboard motor while minimizing or effectively eliminating the inadvertent and concurrent introduction of air to the cooling system and or misdirection of water outside of the inlets during the flushing process.

20 Claims, 1 Drawing Sheet

OUTBOARD FLUSHING ADAPTOR

BACKGROUND OF THE INVENTION

1. Field of the Invention

This invention relates to an adaptor assembly designed to facilitate the flushing of the cooling system of a high performance, low water pick-up type outboard motor by introducing water from a conventional water source into the outboard motor directly into a plurality of water intake openings normally formed in the lower gear case housing portion of the motor.

2. Description of the Related Art

During the operation of conventional, modern day outboard motors of the type used to power marine craft, the engine is cooled by drawing water through one or more water intake holes or apertures formed in the lower gear case housing portion of the outboard motor generally in the area opposite to the location of the driving propeller. After operation, in order to properly maintain the outboard motor and accordingly extend the operable life thereof, it is highly desirable to flush the cooling system utilizing water from a conventional fresh water source such as a garden hose or the like. This is particularly important when the outboard motor is operated in salt or brackish water. The cooling system as well as the various engine parts exposed to salt water are subject to corrosion and deterioration if the salt and other harmful deposits are not removed by flushing the system as set forth above. During the flushing operation, it is desirable to reduce or effectively eliminate the inadvertent introduction of air into the cooling system so that sufficient quantities of water can be flushed through the cooling system in order to remove the salt or other corrosive deposits.

In order to accomplish the flushing of outboard motors, numerous devices are known to exist in the prior art which are structured to facilitate the flushing operation. Such prior art structures include devices which are clamped or otherwise affixed to the lower gear case portion of the engine housing in an attempt to form a seal around at least one of the water intake openings associated with the outboard engine. The known devices also have facilities for connection to a pressurized water source and structure designed to attempt the introduction of flushing water from such water source directly into at least one of the water intake holes of the engine. One problem associated with such devices is the unintended introduction of air into the cooling system through the water intake openings simultaneously to the forcing of pressurized water into the engine. This is usually a direct result of the inability of the prior art devices to create an effective seal about the water intake holes resulting in the unwanted introduction of air and water. This has the effect of reducing the amount of flushing or cleaning water passing through the cooling system which in turn results in an ineffective cleaning of the cooling system and a failure in removing the corrosive deposits therein. Moreover, the reduced amount of water flow through the system during flushing can lead to overheating if the motor is not run strictly at idle during that flushing.

In order to overcome such problems, certain known flushing devices provide for sealing structures which are generally designed to overlie and substantially surround the water intake openings of conventional outboard motors. While well intended, such sealing type structures are frequently ineffective, due at least in part to the irregularity of the outer surface configuration surrounding the water intake openings on the outboard motor as well as the general ineffectiveness in placing such seals in effective sealing engagement or disposition relative to the water intake openings.

In addition to the above problems, modern day high performance outboard motors incorporate a low water pick-up type of design or configuration. This allows the lifting or positioning of the engine at a higher location relative to the water surface and thereby serves to reduce the drag of the lower gear case housing portion of the engine as it passes through the water. In turn, the reduction of drag provides for faster running conditions and better overall performance characteristics. In such modern day, high performance, design configurations, a plurality of small water intake holes are located generally in what may be considered a front or leading portion of the lower gear case housing of the outboard motor. While the plurality of water intake holes may be disposed in a location which is more conducive to allowing water introduction directly therethrough during operation, the irregularity of the surface configuration of this lower gear case housing portion and the small size of the intake holes prevents efficient use of the prior art devices of the type set forth above. Irregularity of the housing surface immediately adjacent to the intake holes would eliminate any effective sealing thereof during the introduction of pressurized water therethrough. Moreover, due to the smaller nature of the intake holes in these higher performance motors, existing clamp over type devices do not adequately direct water into the intake holes. For example, it is a common occurrence with existing devices to have substantial amounts of fluid spillage outside of the holes since more water flows from the larger device than can enter the intake holes. This is primarily due to the fact that existing devices provide a cuff that overlies the openings but does not truly direct or focus the fluid flow to where it needs to go. Accordingly, the flushing water pressure is minimal, is not as effective for cleaning the motor, can take much longer to effectively complete, and wastes large quantities of water which never makes it into the engine so as to cause overheating.

Accordingly, there is a need in this area for an effective flushing adaptor assembly specifically designed to introduce water into the cooling system of a high performance outboard marine engine from a conventional pressurized water source, such as but not limited to a water hose, wherein the flushing water is introduced in a manner which will reduce or effectively eliminate the introduction of air into the cooling system and will effectively concentrate the water flow into the intake holes of this new type of high performance motor. A preferred adapter assembly, of the type required to overcome recognized problems in prior art devices would be specifically structured to introduce water directly and in a concentrated manner into the plurality of water intake holes formed in the engine housing, thereby facilitating flushing without a great risk of overheating. In particular, a preferred adaptor assembly would be ideal for use on newer, modern day, designs including high performance outboard engines wherein the normal water intake holes are small and are formed generally in the leading, lower gear case portion of the housing substantially in the area of, but oppositely disposed to, the location of the driving propeller.

SUMMARY OF THE INVENTION

The present invention relates to an adapter assembly designed to flush out the cooling system of a high performance, low water pick-up outboard motor or engine of the type used to power marine craft. Specifically, the subject flushing adapter assembly serves to connect a pressurized source of water, such as from a conventional water hose, directly to the cooling system of the outboard motor by introducing the water directly into or through the plurality of water intake holes formed in the lower gear case housing portion of the outboard motor.

The subject adaptor assembly comprises a base including an inlet portion and a substantially oppositely disposed outlet portion defining opposite ends of the base. The base itself has at least a partial hollow interior so as to facilitate the flow of water therethrough from the inlet end to the outlet end.

A coupling member is attached to the base adjacent the inlet end and is cooperatively structured therewith so as to establish fluid communication with the inlet end. The coupling structure is preferably in the form of an internally threaded, female coupling member dimensioned and configured to be removably attached to one end of a conventional water hose. By virtue of this connection, water under pressure is delivered to the inlet end of the base from which it passes through the base to the outlet end. The outlet end of the base is defined by a restrictor plate formed of aluminum or other material which is generally resistant to corrosion and which is substantially rigid so as to resist the forces or pressure exerted thereon as water passing through the base exits through the restrictor plate. In order to accomplish the passage of the water through the base and the exiting thereof through the outlet end, at least one but preferably a plurality of apertures or outlet ports are formed in the restrictor plate. A flow of water is thereby established between the inlet end, through the interior of the base and through the outlet ports of the restrictor plate.

A conduit assembly having at least one but preferably a plurality of elongated flexible material conduits, equal in number to the plurality of apertures formed in the restrictor plate, are removably attached or connected to the outlet end of the base. More specifically, each of the conduits comprises a proximal end and a distal end, oppositely disposed from one another. The proximal end of each conduit is connected to the outlet end or restrictor plate by establishing a substantially liquid tight seal with a different one of the plurality of outlet ports formed in the restrictor plate. The attachment between the conduit assembly and the restrictor plate is such as to allow removal of the conduits from their outwardly extending position relative to the restrictor plate when it is desired to disassemble the components of the subject adapter assembly.

The plurality of conduits defining the conduit assembly are preferably equal in number to the number of water intake openings formed in the lower gear case housing portion of the outboard motor. In modern day engines having high performance design configurations, it is typical for such water intake openings to be located on a leading or front portion of the motor housing substantially oppositely disposed to the location of the driving propeller. Further, the number of such water intake openings may vary typically between two and three such openings in stock models, or 5 to 6 in after market models. Accordingly, the number of conduits, as well as the number of water outlet ports formed in the restrictor plate of the base will be preferably equal in number to the aforementioned number of water intake apertures formed in the engine housing. It should be noted, however, that less than all of the intake holes may be filled with a conduit, especially in after market models wherein 5 or 6 exterior intake holes lead to only 2 or 3 interior passages, since the concentrated and pressurized flow of fluid provide by the present invention is sufficient to effectively fill all of the interior passages with a continuous flow water.

An important feature of the present invention is the selective positioning of each of the conduits relative to one another and to the base as such conduits extend outwardly from the restrictor plate. The structure of the present invention allows each of the conduits to be individually positioned for engagement within a different one of the plurality of water intake openings formed in the gear case housing of the motor. The movement of the individual conduits and their selective positioning is further facilitated by the flexible material from which they are formed. In addition to the above, the distal end of each conduit is specifically dimensioned, configured and structured to be at least partially, but preferably substantially, inserted into a different one of the plurality of water intake openings formed in the gear case housing of the motor. Such inserted connection can be sufficiently snug to define or establish an effective water-tight seal between the distal ends of the conduits and the respective water intake openings in which they are inserted. By virtue of this sealed but removable connection of the conduits in the manner described, the inadvertent introduction of air through the water intake openings and into the cooling system will be eliminated or significantly reduced. Moreover, as the conduits extend into the intake openings, the fluid flow is entirely concentrated into the water intake holes under pressure. Therefore, the flushing process, comprising water passing from the attached pressurized water source, through the base and through the individual paths of water flow defined by the individual conduits disposed within the various water intake openings, will be rendered more efficient.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
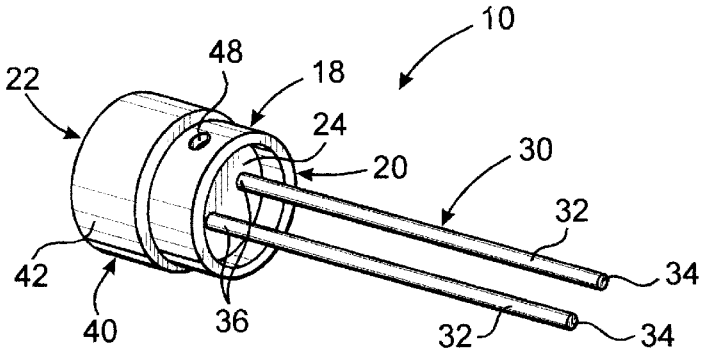
FIG. 1 is a perspective view of the flushing adaptor assembly of the present invention in an assembled form.
Figure 3:
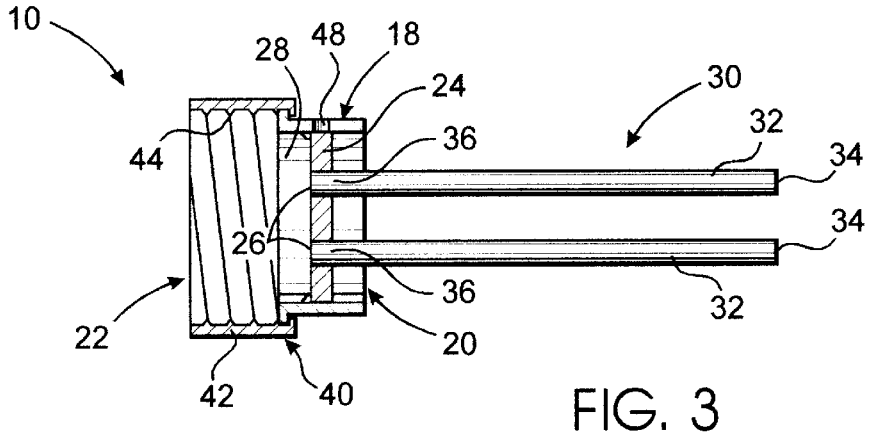
FIG. 3 is a sectional view of the embodiment of FIG. 1 in partial cut-away.
Figure 4:
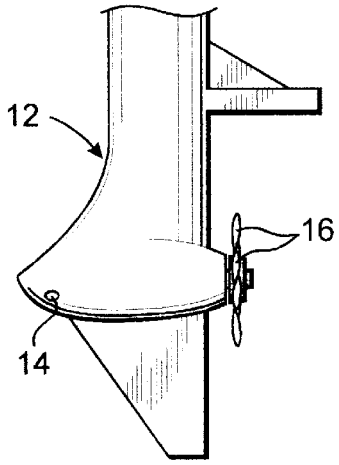
FIG. 4 is a side view of a lower gear case housing portion of an outboard engine.
Figure 5:
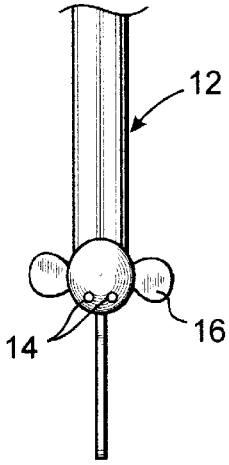
FIG. 5 is a front view of the embodiment of FIG. 4.
Figure 6:
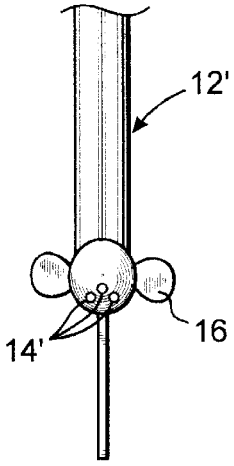
FIG. 6 is an alternative design configuration of a lower gear case housing portion of an outboard engine.

With reference to the accompanying Figures, the present invention is directed to an adaptor assembly generally indicated as 10 in FIGS. 1 and 3 designed to facilitate flushing of cleansing water through the cooling system of a high performance, low water pick-up outboard motor wherein the lower gear case portion of the housing of the outboard motor is generally indicated as 12 and 12' in FIGS. 4–6. More specifically, the adaptor assembly 10 of the present invention is structured to be portable, easily stored, and more importantly to efficiently direct flushing water from a conventional pressurized water source, such as a water hose or the like (not shown for purposes of clarity), into the housing 12 or 12' and eventually through the cooling system. The flushing water passes directly through the plurality of water intake openings 14 or 14' formed in the lower gear case portion of the housing 12 and generally in the leading face of such lower gear case housing portion substantially opposite to the driving propeller 16.

Figure 2:
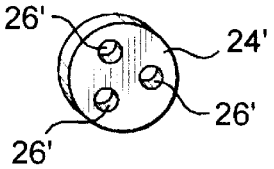
FIG. 2 is a perspective view of a base portion of the embodiment of FIG. 1 disconnected from the other structural components thereof.

With reference to FIGS. 1, 2 and 3, the flushing adaptor 10 comprises a base generally indicated as 18 having an outlet end 20 and an inlet end 22. The outlet end 20 is more specifically defined by a restrictor plate 24 mounted or integrally formed on the base 18. The restrictor plate 24 includes a predetermined number of apertures or outlet ports as at 26 passing therethrough so as to establish fluid communication between a hollow interior portion 28 and the exterior of the base and more specifically a water conduit assembly generally indicated as 30.

It should be noted that the number of water outlet ports 26 preferably conforms to the number of water openings 14 (FIGS. 4 and 5) or 14' (FIG. 6). In modern day, high performance outboard motors, a design configuration exists wherein the outboard motors are referred to as low water pickup type motors. This type of design enables positioning of the engine at a higher location relative to the surface of the water in which the marine craft is travelling. This in turn reduces the drag created by the lower gear case housing portion 12, and faster running conditions as well as a better overall performance characteristics of the motor and the marine craft to which it is attached. In such modern designs the water intake openings 14 communicate directly with the remainder of the cooling system of the engine and are located in the lower gear case portion of the housing 12, generally disposed in a portion of the housing substantially opposite to the driving propeller 16, as best shown in FIG. 4. Depending upon the specific design configuration and the performance characteristics of the engine as well as various models, manufacturers, etc. the openings 14 and 14' vary in number from either two or three such water intake openings (FIGS. 5 and 6) in standard designs, or five to six in after market models. Accordingly, the number of apertures or outlet ports 26 formed in the restrictor plate 24 is preferably equal in number to the number interior passages of the motor or preferably of water intake openings 14 or 14' for which the adaptor assembly 10 is designed to be used. With reference to FIGS. 1 and 2, the restrictor plate 24 of FIG. 1 includes two such outlet ports wherein the restrictor plate in FIG. 2 designated as 24' includes three such outlet ports 26'.

The water conduit assembly 30 comprises a plurality of elongated conduits 32 equal in number to the number of water outlet ports 26 or 26' and each formed preferably of a flexible material and including a distal end 34 and a proximal end 36. Each distal end 34 is specifically dimensioned, configured and structured so as to be at least partially, but preferably substantially inserted directly into a different one of the plurality of water intake openings 14 or 14'. Further, the flexibility of each of the conduits 32 is such as to facilitate proper positioning of each of the conduits 32 such that their distal end 34 can be so inserted. By virtue of this insertion type attachment of the distal ends 34, a generally water-tight seal may be effected, and more importantly, all of the pressurized fluid flow is concentrated and directed into the water intake openings 14 and 14'. Accordingly, the flushing water passes through the base 18 into the conduit assembly 30 and directly into the cooling system through the respective water inlet openings 14 or 14' without the inadvertent intake of air and without water flow loss outside of the openings, conditions that can result in overheating of the engine. Problems existing with prior art adaptor structures in terms of forcing sufficient amounts of flushing water through the cooling system is thereby eliminated. Similarly, the proximal ends 36 of each of the conduits 32 is inserted into the water outlet ports 26 formed in the restrictor plate 24 by a press fit type of connection. A water-tight seal is thereby defined between the respective proximal ends 36 of each of the conduits 32 and the restrictor plate 24 defining the outlet end 20 of the base 18, and all of the flushing water is sent out through the conduits 32.

Another feature of the present invention is the inclusion, preferably as part of the base 18, of a coupling portion generally indicated as 40 in both FIGS. 1 and 3. The coupling portion 40, in a preferred embodiment of the present invention, comprises a connector structure 42 which preferably includes internal threads as at 44 defining a female type of configuration. Further, the overall dimension and configuration of the coupling portion 40 is such as to allow connection of an end of a conventional water hose to the base 18 so as to direct water, under pressure, into the hollow interior 28. The water passes from the interior 28 through the aforementioned water outlet ports 26 into the water conduit assembly 30. Furthermore, in the preferred embodiment of the figures, the coupling portion 40 and the forward section 19 of the base 18 which contains the restrictor plate 24 are movably coupled with one another by a ring 43. As such, the coupling portion 40 can be independently secured to a hose, and the conduits 32 can be independently and easily re-oriented to be properly aligned with the intake openings 14 and 14'. Versatility of the present invention can be increased by allowing both the coupling portion 40 as well as the individual conduits 32 of the conduit assembly 30 to be removably attached to the base 18 so as to facilitate cleaning, storage, replacement of parts, etc.

Along these lines, and as previously indicated, the restrictor plate 24 may also be removably coupled to the base 18. For example, the restrictor plate 24 is dimensioned and configured to be inserted preferably into the interior 28 of the base 18. Once so positioned as shown in FIG. 3, a set screw generally indicated as 48 may be tightened so as to frictionally engage the exterior surface of the restrictor plate 24 in a manner which will allow the removable attachment thereof, while maintaining secure engagement under the pressure of the water flow. As such, the restrictor plate 24' of FIG. 2 may be interchanged with the restrictor plate 24 in the assembled position of FIG. 3. Therefore, the user of the subject adaptor assembly 10 may serve to flush out an outboard motor having either two water inlets 14 or three water inlets 14', as shown in FIGS. 5 and 6 by interchanging the restrictor plates and providing an additional conduit 32. Still, in a most preferred embodiment, the restrictor plate 24 will be fixedly sealed into the base 18 so that a particular adaptor assembly 10 is used with each type of motor.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An adaptor assembly designed to direct flushing water into a water inlet structure of an outboard motor, said adaptor assembly comprising:

a) a base including an inlet end and an oppositely disposed outlet end, b) said base structured to allow water flow therethrough from said inlet end to said outlet end, c) a coupling portion attached to said base adjacent said inlet end and structured to removably connect said base to a source of flushing water, d) a water conduit assembly connected in fluid communicating relation to said outlet end of said base and extending outwardly therefrom, e) said water conduit assembly including a distal end portion removably insertable directly into the water inlet structure of the outboard motor, and f) said water conduit assembly structured to define a path of water flow from said base directly into the water inlet structure of the outboard motor.

2. An adaptor assembly as in claim 1 wherein said water conduit assembly comprises at least one conduit having an elongated configuration and including a proximal end and a distal end, said proximal end secured to said outlet end of said base in fluid receiving relation thereto, and said distal end removably introducible into the water inlet structure of the outboard motor.

3. An adaptor assembly as in claim 2 wherein said distal end of said one conduit is structured to be inserted into the water inlet structure of the outboard motor so as to define a substantially fluid tight inward flow therewith.

4. An adaptor assembly as in claim 3 wherein said outlet end of said base comprises at least one outlet port cooperatively structured with said proximal end of said one conduit so as to receive said proximal end therein and define a substantially fluid impervious sealing engagement therewith, said one conduit defining a substantially closed path of water flow from said base to the water inlet structure through which flushing water is directed.

5. An adaptor assembly as in claim 1 wherein said water conduit assembly comprises a plurality of conduits each having an elongated configuration and each including a proximal end and a distal end, each of said proximal ends secured to said outlet end of said base in fluid receiving relation thereto and each of said distal ends removably insertable into a different one of a plurality of water inlets defining the water inlet structure of the outboard motor.

6. An adaptor assembly as in claim 5 wherein each of said conduits is formed of a substantially flexible material and is disposed in movably spaced relation to one another along at least a portion of the respective lengths thereof, each of said conduits defining a separate, substantially closed path of water flow from said base to a different one of the water inlets of the outboard motor.

7. An adaptor assembly as in claim 6 wherein said plurality of conduits are equal in number to the number of water inlets of the outboard motor.

8. An adaptor assembly as in claim 7 wherein said plurality of conduits comprise at least two.

9. An adaptor assembly as in claim 7 wherein said plurality of conduits comprise at least three.

10. An adaptor assembly as in claim 5 wherein said outlet end of said base comprises a plurality of outlet ports equal in number to said plurality of conduits.

11. An adaptor assembly as in claim 10 wherein said proximal end of each of said plurality of conduits is connected in fluid receiving relation to a different one of said outlet ports of said base, said distal end of each of said plurality of conduits being removably inserted within a different one of the plurality of water inlets of the outboard motor.

12. An adaptor assembly as in claim 11 wherein each of said plurality of conduits defines a separate substantially closed path of water flow from said base to a different one of the water inlets of the outboard motor.

13. An adaptor assembly as in claim 12 wherein said distal end of each said plurality of conduits is dimensioned and structured to fit at least partially into a different one of the water inlets of the outboard motor and define a substantially fluid tight inward flow therewith.

14. An adaptor assembly as in claim 13 wherein the proximal end of each conduit is structured to be fitted at least partially within a different one of said plurality of outlet ports of said base to define a substantially water tight seal therewith.

15. An adaptor assembly as in claim 1 wherein said coupling portion is structured to be removably attached to one end of a water hose.

16. An adaptor assembly as in claim 15 wherein said coupling portion comprises an internally threaded female connector structured to be removably attached to one end of a water hose having an externally threaded male configuration.

17. An adaptor assembly as in claim 15 wherein said coupling portion is removably attached to said base and is disposed and structured to direct flushing water from the water source into said base through said inlet end.

18. An adaptor assembly as in claim 1 wherein said base includes a forward section in which said outlet end is disposed, said forward section and said coupling portion being movably coupled relative to one another so as to permit independent rotation thereof relative to one another.

19. An adaptor assembly designed to direct flushing water into a plurality of water inlets of an outboard motor, said adaptor assembly comprising:

a) a base including an inlet end and an outlet end, said outlet end comprising a plurality of outlet ports, b) said base structured to allow water flow therethrough from said inlet end through said outlet ports of said outlet end, c) a coupling portion connected to said base adjacent said inlet end and in fluid communication therewith, said coupling portion structured to removably connect said base to a source of flushing water, d) a water conduit assembly connected in fluid communicating relation between said outlet end of said base and the plurality of water inlets of the outboard motor, e) said water conduit assembly comprising a plurality of water conduits, equal in number to said plurality of outlet ports and the plurality of water inlets and each conduit including a proximal end and a distal end, f) said proximal end of each conduit structured to define a substantially water tight seal with a different one of said outlet ports when connected thereto, g) said distal end of each conduit structured to fit at least partially into a different one of the water inlets of the outboard motor so as to define a substantially water tight inward flow therewith, and h) each of said plurality of conduits having an elongated configuration and disposed in movable, spaced relation to one another along a portion of the length thereof, and each of said conduits further structured to define a separate, substantially closed path of water flow from said base to the plurality of water inlets of the outboard motor.

20. An adaptor assembly as in claim 19 wherein said outlet end of said base is at least partially defined by a restrictor plate, said plurality of outlet ports formed in said restrictor plate and each outlet port cooperatively dimensioned and structured with a different proximal end of said plurality of conduits so as to removably receive a corresponding one of said proximal ends therein and define a substantially water tight seal therewith.

* * * * *